US011156107B2

(12) United States Patent
Gaillard et al.

(10) Patent No.: US 11,156,107 B2
(45) Date of Patent: Oct. 26, 2021

(54) TURBOMACHINE BLADE

(71) Applicant: SAFRAN AIRCRAFT ENGINES, Paris (FR)

(72) Inventors: Aurélien Gaillard, Paris (FR); Pascal Grégory Casaliggi, Montreuil (FR); Francis Gabriel Michel, Nandy (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 12 days.

(21) Appl. No.: 16/661,212

(22) Filed: Oct. 23, 2019

(65) Prior Publication Data

US 2020/0123913 A1 Apr. 23, 2020

(30) Foreign Application Priority Data

Oct. 23, 2018 (FR) ..... 1859770

(51) Int. Cl.
*F01D 5/30* (2006.01)
*F01D 5/14* (2006.01)

(52) U.S. Cl.
CPC ..... *F01D 5/3007* (2013.01); *F01D 5/141* (2013.01); *F05D 2240/30* (2013.01); *F05D 2250/711* (2013.01); *F05D 2250/712* (2013.01)

(58) Field of Classification Search
CPC ..... F01D 5/3007; F01D 5/141; F01D 5/081; F05D 2240/30; F05D 2250/711; F05D 2250/712; F05D 2250/184; F05D 2250/185; F05D 2260/201; F05D 2260/2214
See application file for complete search history.

(56) References Cited

U.S. PATENT DOCUMENTS 8,622,702 B1 1/2014 Liang
2013/0115081 A1* 5/2013 Wu ..... F01D 5/187 416/1
2016/0348689 A1* 12/2016 Drozdenko ..... F01D 21/045
(Continued)

FOREIGN PATENT DOCUMENTS

EP 0 906 514 A1 4/1999
EP 1 041 246 A1 10/2000
(Continued)

OTHER PUBLICATIONS

Preliminary Search Report as issued in French Patent Application No. 1859770, dated Jul. 5, 2019.

*Primary Examiner* — Christopher Verdier
*Assistant Examiner* — Eric A Lange
(74) *Attorney, Agent, or Firm* — Pillsbury Winthrop Shaw Pittman LLP

(57) ABSTRACT

A turbomachine blade includes a root intended to be mounted in a recessed pocket of a turbomachine rotor disc, the root having two side faces extending radially and longitudinally, each of the side faces including at least one seating intended to be inserted against a side wall of the recessed pocket, along an axis of longitudinal direction and to be in contact with the side walls of the recessed pocket, a radially inner face intended to face the bottom of the recessed pocket when the root is mounted in the recessed pocket, the radially inner face connecting the two side faces, the radially inner face including at least one curved concave surface and two curved convex surfaces, the curved concave surface extending from one end of each of the two curved convex surfaces.

7 Claims, 3 Drawing Sheets

(56) References Cited

U.S. PATENT DOCUMENTS

| | | | | |
|---|---|---|---|---|
| 2017/0218775 | A1* | 8/2017 | Thistle | F01D 5/02 |
| 2017/0218776 | A1* | 8/2017 | Thistle | F01D 5/147 |

FOREIGN PATENT DOCUMENTS

| | | | |
|---|---|---|---|
| EP | 1 136 654 | A1 | 9/2001 |
| EP | 1 234 949 | A2 | 8/2002 |
| EP | 1 365 108 | A2 | 11/2003 |
| EP | 2 639 407 | A1 | 9/2013 |
| EP | 2 896 786 | A1 | 7/2015 |
| EP | 3 098 389 | A1 | 11/2016 |
| EP | 3 199 764 | A1 | 8/2017 |
| EP | 3 199 765 | A1 | 8/2017 |
| WO | WO 2013/180953 | A1 | 12/2013 |

* cited by examiner

TURBOMACHINE BLADE

CROSS-REFERENCE TO RELATED APPLICATIONS

This application claims priority to French Patent Application No. 1859770, filed Oct. 23, 2018, the entire content of which is incorporated herein by reference in its entirety.

FIELD

Generally speaking, the present invention pertains to the field of turbomachine blades, each blade having a root intended to be mounted in a recessed pocket of a turbomachine rotor disc. More specifically, the present invention relates to a turbomachine blade, cooled by cooling channels which traverse the turbomachine rotor disc and emerge in the recessed pocket.

BACKGROUND

In a manner known per se, a turbomachine rotor disc, such as a disc of a stage of the high pressure (HP) turbine, comprises on its outer periphery a plurality of recessed pockets each including two side faces and a bottom. The recessed pockets are regularly distributed around the axis of rotation of the disc and blade roots are mounted in these recessed pockets.

Thus, the blades are fixed to the disc by positioning each root of each blade in a recessed pocket of the disc by sliding each blade root in the longitudinal direction of the recessed pockets.

More specifically, each blade root comprises two side faces of shape complementary to the shape of two side walls of the recessed pocket.

The blades may be entirely metallic or made of ceramic or instead include a vane made of composite and a metal blade root. When the turbomachine is in operation, the gases of the turbomachine circulate while traversing from the upstream to the downstream, respectively the leading edge and the trailing edge of each vane.

The root includes an upstream face situated axially at the level of the leading edge of the blade and a downstream face situated axially at the level of the trailing edge of the blade, the upstream face and the downstream face of the root are axially abutted against the other retaining elements configured to limit the axial movement of the blade along the recessed pocket towards the upstream or towards the downstream.

When the turbomachine is in operation, the airflow path of the high pressure turbine in which the blades are arranged is traversed by gases of which the temperature is very high, particularly on those which are the closest to the combustion outlet.

Since the recessed pockets of the discs that receive the roots of the blades are directly exposed to these gases, it is necessary to cool them to avoid any damage of the discs.

To this end, it is known to withdraw a part of the air of the system for cooling by air which flows outside of the airflow path of the turbine to convey it via a cooling circuit up to the recessed pockets of the rotor discs.

There are mechanical-thermal stresses at the level of the blade roots reducing the lifetime of the blades. It is then known to increase the thickness of the blade while conserving a clearance between the bottom of the recessed pocket and the blade root in order to have a thicker and thus more resistant root.

However, the increase in the mass of each blade has harmful consequences on the lifetime of the discs on which these blades are mounted. Indeed, the efforts created by the centrifugal force due to the rotation of the blades are applied between the side walls of the recessed pocket and the side faces of the blade root.

The increase in the mass of each blade thus increases the centrifugal force applied to the disc. This increase in the centrifugal force increases the stresses applied to the whole of the disc which can weaken the disc and thereby reduce its lifetime. For example, one of the weakened zones may be one of the side walls of the recessed pocket in contact with the side faces of the blade root.

Also known from the document FR2937370 is a solution which consists in modifying the shape of the bottom of the recessed pocket while having a concave curved shape defined by a succession of arcs of circle of at least three different radiuses, to delocalise the tangential compressive stresses under the central part of the bottom of each recessed pocket.

However, this shape of the bottom of the recessed pocket implies always having an extra thickness at the level of the blade root, increasing the mass of the blade. Wedges inserted between the bottoms of the recessed pockets and the blade roots to ensure good positioning of the blade roots in the recessed pockets and thereby to limit wear of the disc are also known from the document FR2946400.

However, all of these solutions increase the mass of the recessed pocket and consequently the problems of mechanical strength.

There thus exists a need to propose a blade capable of withstanding more efficiently mechanical/thermal stresses in operation while limiting the weight of the blade.

SUMMARY

An aspect of the present invention aims to limit the weight of a blade root and the stresses applied to such a blade root arranged in a recessed pocket of a turbomachine rotor disc.

To this end, a first aspect of the invention relates to a turbomachine blade comprising a root intended to be mounted in a recessed pocket of a turbomachine rotor disc while extending radially vis-à-vis a longitudinal axis, the root having:

- two side faces extending radially and axially, each of the side faces including at least one seating intended to be in contact against a wall of the recessed pocket along the longitudinal axis,
  - a radially inner face intended to face the bottom of the recessed pocket when the root is mounted in the recessed pocket, the radially inner face connecting the two side faces, the radially inner face being undulated while including at least one first curved surface, a second curved surface and a third curved surface, the second curved surface extending from one end of each of the first and third curved surfaces and in that
    - either the first curved surface and the third curved surface are concave, and the second curved surface is convex,
    - or the first curved surface and the third curved surface are convex and the second curved surface is concave,
  - in which the radially inner face includes a plurality of undulations formed by an alternation of concave and convex surfaces along the longitudinal axis.

Curved surface is taken to mean a non-flat surface.

Notably, if the second surface is concave or convex, the first and the third surfaces are convex or concave respectively.

Concave is taken to mean a surface forming a hollow in the blade root.

Convex is taken to mean a surface forming a boss towards the exterior vis-à-vis the blade root.

Thanks to the invention, the radially inner face of the blade root makes it possible, when the blade root is mounted in a recessed pocket of a turbomachine rotor disc, to produce a blade root including a curved convex surface forming a zone including more material to increase the life cycle of the blade. Thus, this makes it possible to have a root having more material in the zones undergoing the most stress, for example compressive stresses, and less material in the zones undergoing less stress, thereby making it possible to optimise the weight/wear ratio of the blade. Indeed, in the prior art, it was standard practice to increase the thickness of the blade root whether it is in the zones undergoing less stress or more stress. The weight of the blade is thus heavier in the prior art than in that of the invention.

Moreover, the fact of having a concave or convex surface that extends from one end of one of the two convex or concave surfaces respectively makes it possible to avoid having a sharp edge between a curved surface notably concave and a flat surface causing stress concentration zones and thus premature wear in these zones. Indeed, the fact of connecting a convex surface to a concave surface makes it possible to limit the stress gradients between the two surfaces.

According to a second aspect of the invention which relates to an assembly including at least one turbomachine blade according to the first aspect of the invention which can include the characteristics of the different embodiments next described and a turbomachine rotor disc mounted around the longitudinal axis and including, on its periphery, a plurality of recessed pockets regularly distributed around the longitudinal axis, the root of the at least one blade being mounted in a recessed pocket of the plurality of recessed pockets so as to form a mounting clearance between the root of the blade and the bottom of said recessed pocket.

The turbomachine blade according to the first aspect of the invention or the assembly, according to the second aspect of the invention, of a turbomachine rotor disc and at least one blade according to the first aspect of the invention, may have one or more complementary characteristics among the following, considered individually or according to all technically possible combinations thereof.

According to a first embodiment, the radially inner face includes a plurality of undulations formed by an alternation of concave and convex surfaces and in that each concave surface extends between two convex surfaces.

According to an example, the radially inner face includes a fourth curved surface extending from the third curved surface, the fourth curved surface being curved like the second curved surface. In other words, if the second curved surface is concave, the fourth curved surface is concave and if the second curved surface is convex, the fourth curved surface is convex.

According to a second embodiment, which can include the characteristics of the preceding embodiment, each curved concave or convex surface is rounded.

According to a third embodiment, which can include the characteristics of the preceding embodiments, the radially inner face includes a convex surface at the centre of the radially inner face.

For example, the convex surface situated at the centre includes a radius which extends in the transversal direction of the radially inner face.

According to an embodiment of this example, the convex surface situated at the centre extends over the whole length of the radially inner face. In other words, the convex surface is situated in a median zone of the width of the radially inner face over the whole length of the radially inner face.

According to a particularity of this example, the convex surface extends over the whole length parallel to the longitudinal direction. That is to say that it includes the same curvature over the whole length of the radially inner face.

According to another example, the convex surface situated at the centre includes a radius which extends in the longitudinal direction of the radially inner face.

According to an embodiment of this example, the convex surface situated at the centre extends over the whole width of the radially inner face. In other words, the convex surface is situated in a median region of the length of the radially inner face over the whole of its width.

According to a particularity of this example, the convex surface extends over the whole width of the radially inner face. That is to say that the convex surface at the centre includes the same curvature over the whole width of the radially inner face. According to another example, the convex surface situated at the centre is according to the first example and the second example.

In this example, the root may include an ellipsoid having the convex surface situated at the centre. The convex surface is a curve in both axes and thus has an ovoid shape or in a particular case is spherical of same value of radius and same centre. Transversal direction is taken to mean in the direction of the width, i.e. perpendicular to the longitudinal direction which is parallel to the axis of rotation.

According to a fourth embodiment, which can include the characteristic of the preceding embodiments, the radially inner face includes a plurality of undulations formed by an alternation of concave and convex surfaces along the transversal axis.

According to an example of this embodiment, the curved concave and convex surfaces undulate in the transversal direction while connecting together the two side faces.

According to an example, the curved concave and convex surfaces form a radially inner face which undulates transversally from one side face to the other side face. The radially inner face thus includes concave and convex surfaces which follow each other in the transversal direction.

According to an example of this fourth embodiment, the concave surfaces and the convex surfaces are aligned perpendicularly to the longitudinal axis.

According to an example of this fourth embodiment, each curved convex surface extends over the whole length of the radially inner face.

According to a particularity of this example, each convex surface extends over the whole length parallel to the longitudinal direction. That is to say that each convex surface includes the same curvature over the whole length of the radially inner face. In other words, in each radial section of the blade, the same curved convex surface includes the same convex radius.

This makes it possible to produce easily the curved convex surface.

According to another example of this fourth embodiment, which can be combined with the preceding example, each curved concave surface extends over the whole length of the radially inner face.

According to a particularity of this example, each concave surface extends over the whole length parallel to the longitudinal direction. That is to say that each concave surface includes the same curvature over the whole length of the radially inner face. In other words, in each radial section of the blade, the same curved concave surface includes the same convex radius.

This makes it possible to produce easily each curved concave surface.

According to an alternative of the two preceding examples, each curved concave or convex surface extends into a median region of the radially inner surface of the root, the median region being situated at a distance from an upstream face and from a downstream face of the blade root.

According to an embodiment of the particularities of one of these examples, each curved concave or convex surface includes a portion of a cylinder of which the axis is parallel to the longitudinal axis.

In an exemplary embodiment, the curved and concave surfaces each include a surface of a cylinder of which the axes of each cylinder are parallel with each other and in that each axis of each cylinder is parallel to the two side faces.

In the case of mounting against a side wall of the recessed pocket parallel to the axis of rotation, the curved or concave surfaces include a radius of which the circle is situated in a plane transversal to the axis of rotation.

According to an example, the radially inner face has a width that extends between a first width end intended to be in contact with a first side wall of the recessed pocket and a second width end intended to be in contact with a second side wall of the recessed pocket, and in that the root includes a radial thickness between the radially inner face and a plane passing through the first width end and through the second width end and in that the thickness varies in a continuous manner from the first width end up to a top of a central convex surface of the radially inner face and the second width end up to the top of the central convex surface of the radially inner face.

At the level of the first width end and the second width end, the radial thickness is thus zero. The first width end and the second width end are thus each a longitudinal intersection line between the radially inner face and the corresponding side face.

The plane thus passes through the longitudinal intersection line of the radially inner face and the first side face of the root and through the longitudinal intersection line of the radially inner face and the second side face of the root.

In this example, each curved concave surface has a shape such that the curved concave surface moves away from the plane passing through the two longitudinal intersections and increases the radial thickness of the root while coming closer to a median region in the direction of the width.

In other words, the tangents of the curved concave surfaces are inclined towards the median zone along the width and towards the axis of rotation. The tangents of the curved concave surfaces thus form an angle with the plane passing through the longitudinal intersection lines on the side of the longitudinal intersection the closest to the corresponding curved concave surface.

Thus, the zones undergoing the most stresses in the median region of the blade comprise more material.

According to an embodiment of this example, the first width end and the second width end of the radially inner face include a radius forming a curved convex surface.

According to a fifth embodiment, which can comprise the characteristics of one of the embodiments described previously, the curved concave and convex surfaces undulate along the longitudinal axis from an upstream face of the root to a downstream face of the root.

According to an example, the curved concave and convex surfaces forming the radially inner face undulate along the longitudinal axis while connecting an upstream face to a downstream face.

According to an example of this embodiment, the concave and convex surfaces are aligned along the longitudinal axis.

The radially inner face thus includes concave and convex surfaces which follow each other in the longitudinal direction.

Each concave and convex surface thus includes radiuses which extend in the longitudinal direction of the radially inner face.

According to an example of this fifth embodiment, each curved convex surface extends over the whole width of the radially inner face.

According to a particularity of this example, each convex surface extends over the whole width of the radially inner face. That is to say that each convex surface includes the same curvature over the whole width of the radially inner face.

In other words, in each longitudinal section parallel to the longitudinal direction of the blade, the curved convex surface includes the same convex radius.

This makes it possible to produce easily the curved convex surface.

According to another example of this embodiment being able to be combined with the preceding, each curved concave surface extends over the whole width of the radially inner face.

According to a particularity of this example, each concave surface extends over the whole width of the radially inner face. That is to say that each concave surface includes the same curvature over the whole width of the radially inner face.

In other words, in each longitudinal section parallel to the longitudinal direction of the blade, the curved concave surface includes the same concave radius.

This makes it possible to produce easily the curved concave surface.

According to an alternative of this preceding embodiment, each curved concave or convex surface extends into a median region of the radially inner surface of the root, the median region being situated at a distance from the side faces of the blade root.

According to an example, the radially inner face of the root of the blade has a length that extends between a first length end forming an intersection line with an upstream face of the root and a second length end forming an intersection line with a downstream face, and in that the radially inner face includes a radius forming a curved convex surface at the first length end as well as at the second length end and in that the root includes a radial thickness between the radially inner face and a plane parallel to the axis of the axial direction passing through the first length end and the second length end and in that the radial thickness varies continuously in a sinusoidal manner while having a radial thickness measured radially between the radially inner face that is maximum at the level of a curved convex surface and a zero height which is the smallest height measured at the first length end and at the second length end.

The radial thickness at the level of a top of a concave surface is thus less in this example than the radial thickness level of each top of the two contiguous convex surfaces.

According to an embodiment of this example, the plane further passes through a longitudinal intersection line of the radially inner face and the first side face and through a longitudinal intersection line of the radially inner face and the second side face.

According to a sixth embodiment being able to comprise the characteristics of the preceding embodiments, the curved or concave surfaces each include a portion of a cylinder.

For example, in combination with the sixth embodiment, each curved concave or convex surface includes a portion of a cylinder of which the axis is parallel to the longitudinal axis.

For example, in combination with the seventh embodiment, each curved concave or convex surface includes a portion of a cylinder of which the axis is perpendicular to the longitudinal axis.

According to a seventh embodiment, comprising the characteristics of the fourth and fifth embodiments described previously, the radially inner face comprises an undulated region comprising undulated concave surfaces and undulated convex surfaces each extending along a radius of which the circle and the centre forming the radius are situated in a plane parallel to the axis of longitudinal direction and another radius of which the circle and the centre forming the radius are situated in a plane transversal to the axis of longitudinal direction.

According to an example of this embodiment, at least one of the concave surfaces of the undulated region includes a wall portion of an ovoid.

According to an example of this embodiment being able to be combined with the preceding example, at least one of the convex surfaces of the undulated region includes a wall portion of an ovoid.

According to an example, which can include these two latter examples, the root includes undulated bosses and undulated hollows in the undulated region of the radially inner face.

In this example, the root comprises an upstream length end forming the intersection line with the upstream face and a downstream length end forming the intersection line with the downstream face and a radial thickness greater than 0 between the bottom of the hollow and a plane passing through the upstream and downstream length ends and notably the width ends of the radially inner face.

According to an example of this embodiment, the undulated convex surfaces of the zone are ellipsoid or spherical.

In other words, the centre of the circle of the radius situated in a plane transversal to the axis of direction is also the centre of the circle of the radius situated in a plane parallel to the axis of direction.

According to an example, the undulated region is a central zone of the radially inner face.

According to an example of this seventh embodiment, the radially inner face includes, on either side of the undulated region, a side convex surface including at least one convex radius that extends in the transversal direction of the radially inner face and in which the side convex surface extends regularly all along the root and in that each side convex surface extends from a side face of the root.

According to an embodiment, the root comprises, on either side of the undulated region, a concave surface extending regularly all along the undulated region and having a concave radius between the undulated region and the side convex surface.

According to an embodiment of the assembly, said recessed pocket includes cooling channels which emerge radially in the bottom of said recessed pocket.

This makes it possible to improve the exchange coefficient between the disc and the cooling air and to increase the quantity of thermal flux extracted from the disc. The cooling efficiency of the disc is thereby improved.

According to an example, the radially inner face forms with the bottom of the recessed pocket a channel comprising different sizes of section along the longitudinal direction. Thus, the radially inner face is beneficially arranged so that the curved convex surfaces are against a flux circulating between the bottom of the recessed pocket and the root of the blade. This configuration is more efficient in terms of thermal exchange.

According to an embodiment of the assembly, the recessed pocket includes inter-cavity partitions which separate the cooling channels and in that the tops of the curved convex surfaces of the root of the blade are laid out in line with the inter-cavity partitions.

The zones of the root undergoing the most stresses are, in the cooled blades, at the level of the zones facing the inter-cavity partitions of the disc, that is to say the zones of the roots facing the inter-cavity partitions that separate the cooling channels of a recessed pocket. Indeed, it is these volumes which are compression loaded and thus which undergo the most stresses. Thus, the convex surfaces in this zone make it possible to increase the material of the root in this zone to increase their lifetime. Thus, this embodiment allows that the root comprises more material at the level of the zones undergoing the most stresses to make it possible to withstand them better.

According to an example of this embodiment of the assembly, the curved concave surfaces are facing the cooling channels. This makes it possible to increase the clearance necessary for ventilation in this zone while decreasing the weight of the blade.

According to an embodiment which can include the characteristics of the preceding embodiment, each side face of the root includes side curved concave and convex surfaces, and in that each side wall of the recessed pocket includes a curved convex surface situated in the side curved concave surface of the root and includes two curved concave surfaces around side curved convex surfaces of the side face of the root, the curved convex surface of the side wall being situated between the two curved concave surfaces of the side wall.

According to an example, the assembly includes:

- a clearance between the bottom of the curved concave surface of a side wall of the recessed pocket and the curved side convex surface of the root and
- a clearance between the bottom of the side concave surface of the root and the curved convex surface of each side wall of the side wall of the recessed pocket.

This makes it possible to have a mounting of the roots in the recessed pockets with clearance making it possible on the one hand to have simpler manufacturing tolerance constraints but also that the root of the blade or a head between two recessed pockets can expand as a function of the temperature differences applied to the blade and to the disc.

In this embodiment, the seating are in contact with the side walls of the recessed pocket and are suited to sliding in the longitudinal direction along the fastener. According to another embodiment, the radially inner face has a width that extends between a first width end intended to be in contact with a first side wall of the recessed pocket and a second width end intended to be in contact with a second side wall of the recessed pocket, and in that the root includes a radial thickness between the radially inner face and a plane passing through the first width end and through the second width end.

The invention and its different applications will be better understood on reading the description that follows and by examining the figures that accompany it.

BRIEF DESCRIPTION OF THE FIGURES

The figures are presented for indicative purposes and in no way limit the invention.

DETAILED DESCRIPTION

Unless stated otherwise, a same element appearing in the different figures has a single reference.

Figure 1:
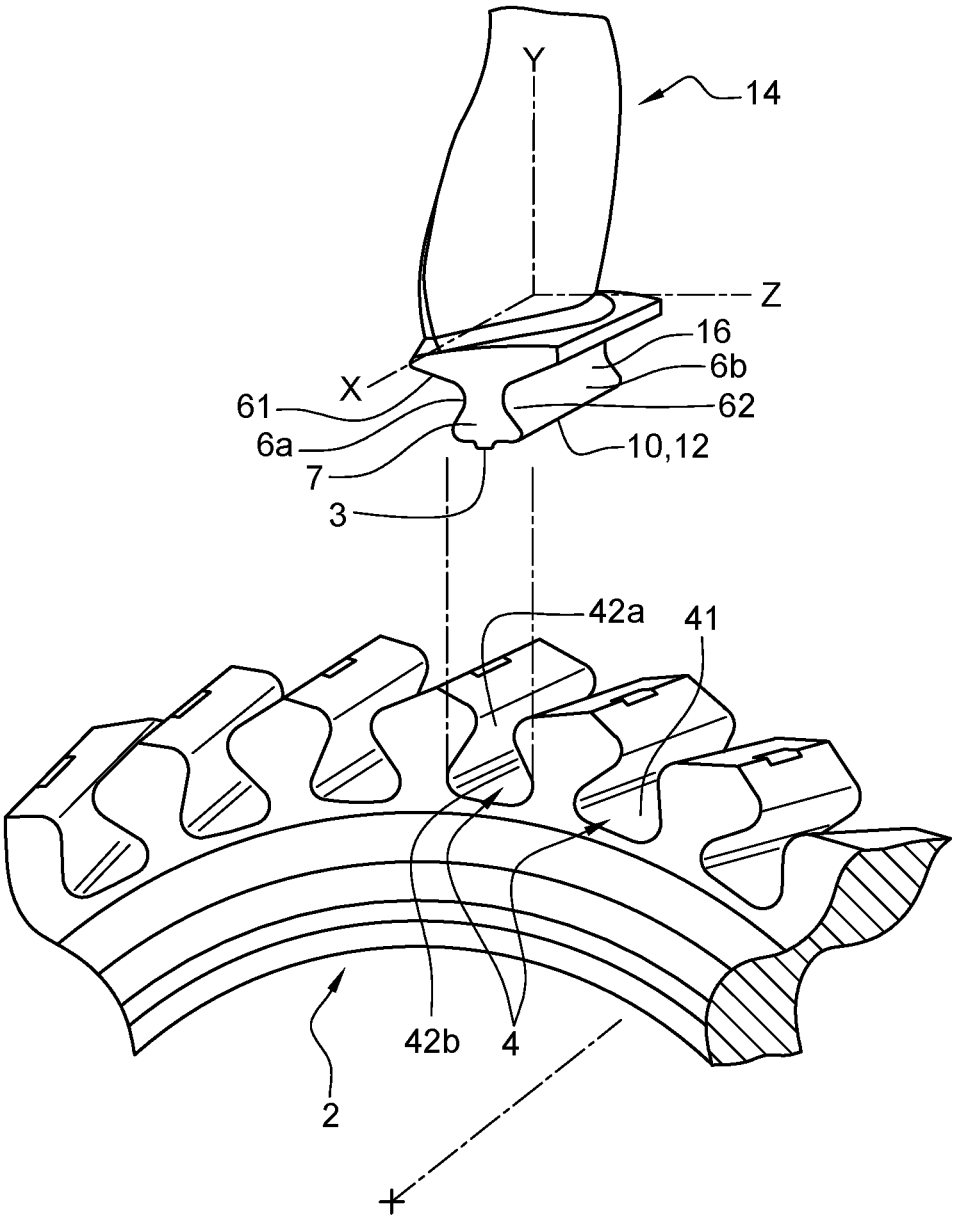
FIG. 1 partially represents, in exploded view and schematically, a turbomachine rotor disc and a blade root according to a first example of a first embodiment of the invention.
Figure 2:
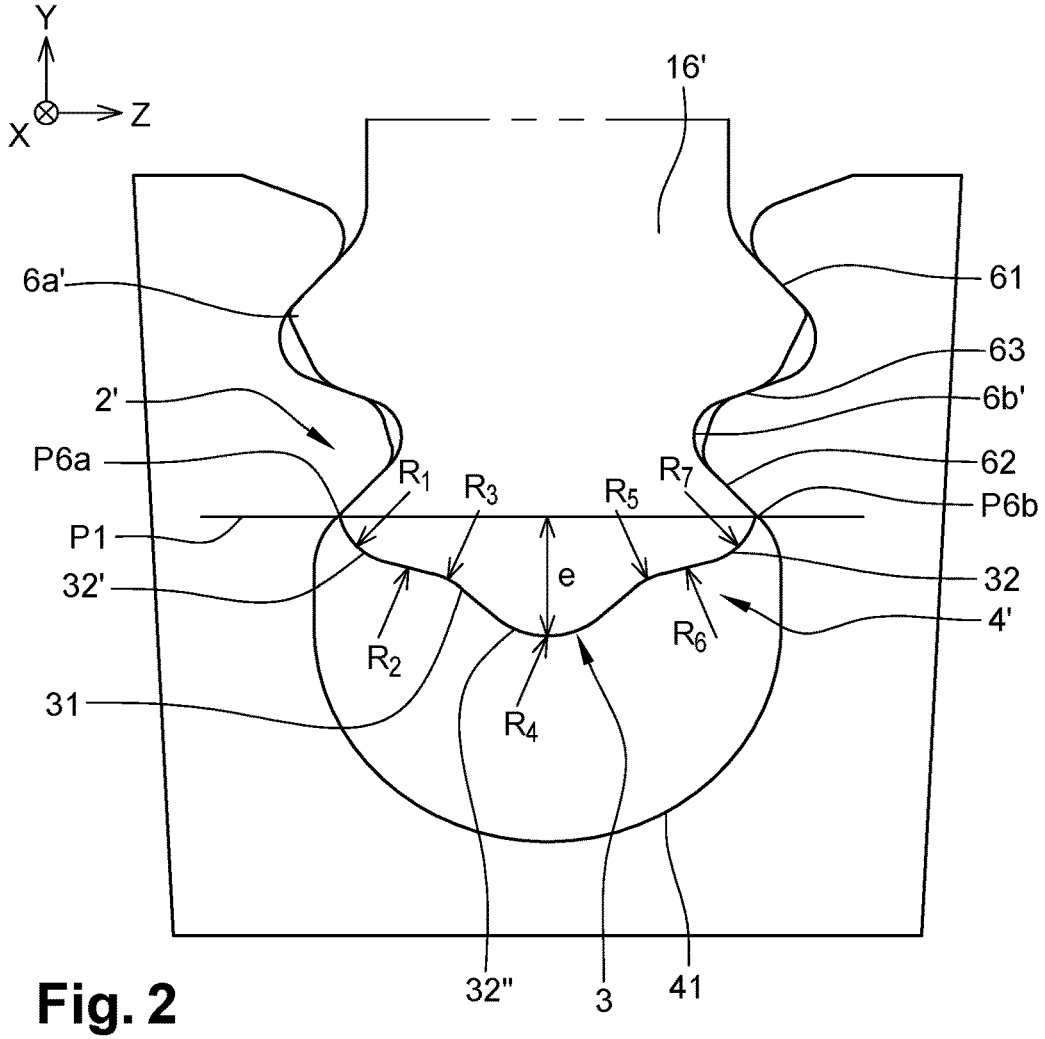
FIG. 2 partially represents, schematically in section, a turbomachine rotor disc and a blade root according to a second example of the first embodiment of the invention.

FIG. 1 represents partially, in exploded view and in a schematic manner, a first example of root 16 of the blade 14 according to a first embodiment of the invention and partially an example of turbomachine rotor disc 2. FIG. 2 schematically shows a radial section of a root 16' according to a second example of this embodiment in a recessed pocket of a second example of disc 2'.

The disc 2, extends around an axis of rotation A, comprises on its periphery a plurality of recessed pockets 4 open towards the exterior of the disc 2 and regularly distributed angularly around the axis of rotation A of the disc 2.

The blade 14 has an extension dimension along a first direction or radial direction y and is intended to be mounted in a recessed pocket 4 of the disc 2 in rotation around an axial direction A or axis of rotation A. The blade 14 includes a root 16 mounted in the recessed pocket 4 of the disc 2, so as to form a blade-disc link. At each point of the blade 14 are defined:

- the first radial direction y along the extension dimension of the blade 14,
- a second axial direction x, perpendicular to the radial direction and parallel to the axis of rotation A, and
- a third direction or tangential direction z, perpendicular to the radial direction y and to the axial direction x.

In particular, when the blade 14 is mounted in a recessed pocket 4 of the disc 2:

- the radial direction y is along a radius of the disc 2 or in other words perpendicular to the axis of rotation A of the disc 2;
- the axial direction x is parallel to the axis of rotation A of the disc 2 and
- the tangential direction z is both perpendicular to the radial direction y and perpendicular to the axial direction x.

Hereafter, the axial direction x is also designated the longitudinal axis x of the blade root, which is thus parallel to the axis of rotation A.

The root 16 includes a radially inner face 3 and the recessed pocket 4 includes a bottom 41 facing the radially inner face 3.

The radially inner face 3 is opposite the radial direction, the face of the root 16 the closest to the axis of rotation A.

The root 16 also includes at its radially outer end, radially opposite to the radially inner face of the root, a platform from which a vane extends radially outwards.

The root 16 and the recessed pocket 4 are dimensioned so as to arrange, when the root 16 is mounted in the recessed pocket 4, a space or mounting clearance between the bottom 41 and the radially inner face 3 of the root 16, in which cooling air can circulate.

The root 16 comprises a first side face 6*a* and a second side face 6*b* extending in the axial direction x and in the radial direction y. In particular, the side face 6*a* and the side face 6*b* form a dovetail root 16. The root 16 further includes an upstream face 7 and a downstream face extending in the tangential direction Z and in the radial direction y.

The radially inner face 3 is delimited longitudinally on either side by the upstream face 7 and the downstream face and transversally, in other words over its width, on either side by the side face 6*a* and the side face 6*b*.

The radially inner face 3 thus extends in the axial x and tangential Z direction.

In particular, on an upstream face 7 of the root 16 may be seen the dovetail shape. The recessed pocket 4 includes two side walls 4*a*, 4*b*, of shape complementary to the side faces 6*a*, 6*b* of the root 16. In particular, each side wall 4*a*, 4*b* includes in this first example a portion of radially outer wall 42*a* having a curved convex surface and a portion of radially outer wall 42*b* having a curved concave surface. Each side wall 4*a*, 4*b* is in contact respectively with the side faces 6*a*, 6*b* of the root 16 of the blade 14.

In this example, each of the two curved side faces 6*a*, 6*b* comprises a concave surface each including radiuses forming a radially outer seating 61 and a radially inner seating 62. Each seating surface 61, 62 is in contact with a side wall of the recessed pocket 4, along an axis of longitudinal direction Y, which in this example is parallel to the axis of rotation A.

FIG. 2 schematically shows a second example of root 16' of the blade 14 according to an embodiment of the invention. The root 16' according to the second example comprises a first and a second side face 6*a*', 6*b*' different from those of the first example in that each of these two side faces 6*a*', 6*b*' further comprises a convex surface in the radially outer part of the side face whereas the root 16 according to the first example does not comprise one.

The root 16' comprises on each of these two side faces 6*a*', 6*b*', a radially outer seating 61 formed by the convex surface, an intermediate seating 63 formed by the concave and convex surface, and a radially inner seating 62 formed by the concave surface.

In this second example, each side wall 4*a*', 4*b*' (referenced in FIG. 5 and described in detail hereafter) of the recessed pocket 4' comprises a portion of radially inner side wall and a portion of radially outer side wall. The radially outer seating 61 is in contact with the portion of radially outer side wall. The radially inner seating 62 and the intermediate seating 63 are in contact with the portion of radially inner wall. Each portion of radially inner wall includes a curved convex surface 463 visible notably in FIG. 5 detailed hereafter representing a radial view of the recessed pocket 4' of the disc 2'. Each portion of radially outer wall includes a curved concave surface and a free curved convex surface.

The intermediate seating 63 is thus in contact with the convex surface 463 of the portion of radially inner wall.

Side mounting clearances between the root 16' and the side walls 4*a*', 4*b*' of the recessed pocket 4' are formed on the one hand between the radially outer seating 61 and the intermediate seating 63 and on the other hand between the intermediate seating 63 and the radially inner seating 62. In other words, a side mounting clearance is formed between the convex surface of each side face 6*a*', 6*b*' of the root 16' and the curved concave surface of the portion of radially outer wall of each side wall 4*a*', 4*b*' of the recessed pocket 4'. Another mounting clearance is formed between the concave surface of each of the side faces 6*a*', 6*b*' of the root 16' and the curved convex surface 463 of the portion of radially inner wall of each side wall 42*a*, 42*b*.

The root 16' according to the second example is furthermore analogous to the root 16 according to the first example. In particular, the radially inner face 3 of the two examples of this embodiment is identical.

FIG. 2 represents a radial section of the radially inner face 3 according to this first embodiment.

Figure 3:
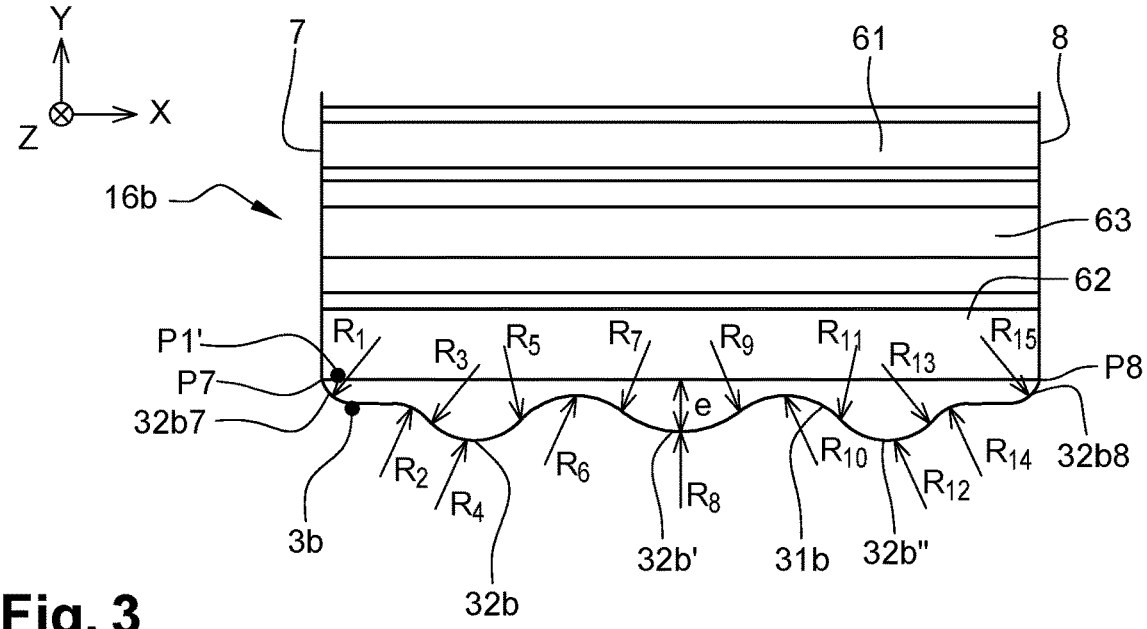
FIG. 3 schematically represents a section of blade root according to a second embodiment of the invention.

A second embodiment of another root 16*b* is represented in FIG. 3, along an axial section of the root 16*b*, and is identical to the root 16' except in that it includes a radially inner face 3*b* different from the radially inner face 3. A third embodiment of a root 16*c* is represented in perspective in FIGS. 4*a* and 4*b*, and is identical to the root 16' except in that it includes a radially inner face 3*c* different from the radially inner face 3'.

The common characteristics of the three embodiments will now be described and the characteristics of each of the different embodiments, in particular the different shapes of the radially inner faces 3, 3*b*, 3*c*, are described hereafter.

In these three embodiments, the radially inner face 3, 3*b*, 3*c* has a width dimension along the tangential direction Z and a length dimension along the axial direction x greater than the width dimension along the tangential direction z. The width and length dimensions are each along a distinct direction and perpendicular to the radial direction y.

The radially inner face 3, 3*a*, 3*b* of each embodiment includes at least one curved concave surface 31, 31*b*, 31*c* and at least two curved convex surfaces 32, 32*b*, 32*c*. In each of the embodiments, the curved concave surface 31, 31*b*, 31*c* extending from one end of each of the curved convex surfaces 32, 32*b*, 32*c*.

In the first embodiment represented in FIGS. 1 and 2, the channel face 3 includes curved concave surfaces 31 and curved convex surfaces 32 in such a way that the radially inner face 3 undulates transversally with respect to the side faces 6*a*, 6*b*. The curved concave surfaces 31 and the curved convex surfaces 32 are each called hereafter respectively concave surface 31 and convex surface 32. In this case in this example, the concave surfaces 31 and the convex surfaces 32 undulate in the transversal direction while connecting together the two side faces 6*a*, 6*b*.

In other words, in this first embodiment, the radially inner face 3 undulates along the tangential direction 7. In this case, the channel face 3 includes two concave surfaces 31 each including a concave radius R3, R5 extending along the transversal direction and three convex surfaces 32.

"Concave radius" is taken to mean a fillet shape, while "convex radius" is taken to mean a rounded shape and "radius" is taken to mean the distance between a centre and an arc of circle.

In the two examples of the first embodiment represented in FIGS. 1 and 2, each section of concave or convex surface includes a portion of a cylinder including an axis along the longitudinal direction but could very well be irregular over the length or the width while having a radius value which varies longitudinally or transversally and have a portion of an ovoid for example. However, the shape of longitudinally regular cylinder portion makes it possible to facilitate the machining or the moulding of the curved surface, whether it is concave or convex.

One of the three convex surfaces 32 is a central convex surface 32" extending between the two concave surfaces 31. The two other convex surfaces 32, hereafter called side convex surfaces 32', are each situated on each side, along the width, of the radially inner face 3. The two side convex surfaces 32' each extend from a radially inner seating 62 of each side face 6*a*, 6*b*. These two side convex surfaces 32' each include in this case two convex radiuses R1, R2 and R7, R6 extending along the transversal direction. On each side, the first convex radius R1, R7 is rounded tangentially to the radially inner seating 62 and includes a smaller radius than the convex radius R2, R6 joining the concave radius R3, R5. In other words, in this example, the two side convex surfaces 32' each include two portions of cylinder having a different radius value and a different axis parallel to the axis of axial direction x.

The central convex surface 32' only includes a single convex radius R4 along the transversal direction joining the two concave radiuses R3, R5.

It will be appreciated that the third convex surface could very well have one or two or more convex radiuses and the two concave surfaces could also have two or more concave radiuses.

The convex 32 and concave 31 surfaces of the radially inner face 3 are tangential to each other.

Thus, this makes it possible not to form a sharp edge which can undergo more stress and thus faster wear of the root.

Notably, the convex radiuses R2, R6 of the side convex surfaces 32' with the concave radiuses R3 R5 of the concave surfaces are sufficiently large so that the change of direction enables the surfaces to extend from each other in a continuous manner.

Figure 5:
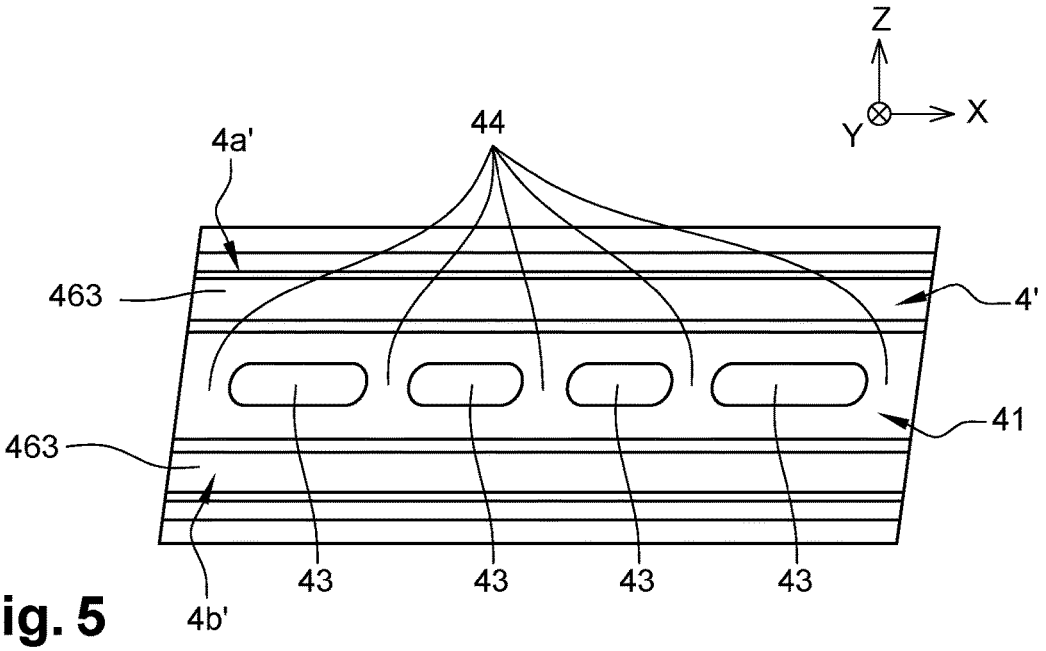
FIG. 5 partially represents a recessed pocket of a rotor disc including cooling channels.

FIG. 5 represents a radial view of the recessed pocket 4' of this second example of this embodiment. As described previously, in this FIG. 5, the convex surface 463 of the recessed pocket 4' may be seen.

The recessed pocket 4' includes in this second example cooling channels 43 emerging radially in the bottom 41 and which are aligned following one another along the axial direction x forming between them inter-cavity partitions 44 including an axial surface forming the bottom 41. Each inter-cavity partition 44 separates two cooling channels.

Each cooling channel emerges along the width, that is to say the tangential direction Z, in a median region of the bottom 41. Thus, in this example of this embodiment, the central convex surface 32" is laid out in line with each cooling channel outlet and each inter-cavity partition.

It is in this median region that the root 16' undergoes the most stresses and thus the convex shape makes it possible to improve the wear resistance of the root 16' in this region.

Moreover, in this first embodiment, the root 16 of the first example or the root 16' of the second example includes a radial thickness e between the radially inner face 3 and a plane P1 extending along the axial direction x and the tangential direction Z passing through a first width end called p6*a* and a second width end p6*b* of the radially inner face 3. More specifically, the first transversal end p6*a* is formed between the intersection of the radially inner seating 62 of the first side face 6*a*' and the convex radius R1 and the transversal end p6*b* is formed between the intersection of the radially inner seating 62 of the side face 6*a*' and the convex radius R1. The radial thickness e is thus zero at the two width ends p6*a* and p6*b*.

According to another example, not represented, the plane p1 further passes through an upstream longitudinal end and a downstream longitudinal end of the radially inner face 3.

The radial thickness e is thus measured along the radial direction y and varies transversally, that is to say along the width of the root, which is the tangential direction Z.

In this example of this embodiment, the radial thickness e increases continually from the width end p6*a* to the top of the central convex surface 32" and increases continually from the width end p6*b* to the top of the central convex surface 32". The radial thickness e is thus the greatest at the level of the top of the central convex surface 32".

The curved concave surfaces 31 each have a concave radius such that the radial thickness e increases progressively towards the central convex surface 32'.

The centre of each concave radius R3, R5 is thus sufficiently shifted towards the side ends so that the tangents of the concave surfaces 31 are inclined such that they form an angle with the plane P1 on the side of the corresponding longitudinal end.

According to another example, not represented, the radial thickness e decreases in the concave surfaces.

According to this first embodiment, the radially inner face 3 may further comprise curved concave and convex surfaces which undulate along the longitudinal direction. In this case, the section of FIG. 2 is situated either in a top of a convex surface which undulates along the longitudinal direction, or in a regular longitudinal part (of which the thickness e does not undulate along the longitudinal axis). In the case of a regular longitudinal part, the radially inner face 3 may include curved concave and convex surfaces which extend between the regular part and an upstream or downstream longitudinal end.

According to a second embodiment of the invention, of which an example of a section along the longitudinal axis x of a root 16*b* is represented in FIG. 3, the root 16*b* is identical to the root 16' of the first embodiment, except in that the radially inner face 3*b* is different in that the curved concave and convex surfaces undulate uniquely along the longitudinal direction. In this example, the concave and convex surfaces are curved along the axis of axial direction x and not along the tangential axis Z as in the first embodiment.

The radially inner face 3*b* of the root of the blade has a length which extends between a first longitudinal end P7 forming the intersection line with the upstream face 7 and a second longitudinal end P8 forming the intersection line with a downstream face 8.

In this example, the concave surface 31*b* and the convex surface 32*b* undulate in the longitudinal direction and connect together the upstream face to the downstream face.

In this example, the radially inner face 3*b* includes five curved convex surfaces 32*b*. One of the five curved convex surfaces 32*b*, hereafter called upstream convex surface 32*b*7, extends from the first longitudinal end P7 and another of the five curved convex surfaces 32*b*, hereafter called downstream convex surface 32*b*8, extends from the second longitudinal end P8.

One of the three other curved convex surfaces 32*b* is hereafter called central convex surface 32*b*' and is situated along the longitudinal axis x between the two other curved convex surfaces 32*b* hereafter called curved intermediate surface 32*b*". Each curved convex surface 32*b* and each curved concave surface 31*b* extends over the whole width of the radially inner face 3*b*.

The radially inner face 3*b* includes four curved concave surfaces 31*b* each connected to two curved convex surfaces 32*b* in a continuous manner.

A plane P1' in this example of this second embodiment passes through the first longitudinal end P7 and the second longitudinal end P8.

According to another example, not represented, the plane P1' may also further pass through the first and second transversal ends of the radially inner face 3*c*.

In this represented example of this second embodiment, the radial thickness e of the root measured between the plane P1' and the radially inner face 3*b* varies in a sinusoidal manner while increasing in the convex surfaces and while decreasing in the concave surfaces.

This example of root 16*b* of this second embodiment is also suited to be housed in the recessed pocket 4' represented in FIG. 5.

When the root 16*b* is mounted in the recessed pocket 4', the two intermediate convex surfaces 32*b*" and the central curved convex surface 32*b*' are each laid out in line with an inter-cavity partition 44 of the bottom 41.

The root 16*b* undergoes the most stresses in the convex surfaces 32*b*' and 32*b* and thus makes it possible to improve the wear resistance of the root 16' in this region.

In this example of this second embodiment, the two intermediate convex surfaces 32*b*" and the central convex surface 32*b*' each include three convex radiuses R3, R4, R5, R11, R12, R13 and R7, R8, R9 extending along the longitudinal direction, in this case along the axial direction. The concave surfaces 31*b* each include only a single concave radius R2, R6, R10 and R14 extends in the longitudinal direction, in this case in the axial direction x.

Two of the three convex radiuses of an intermediate convex 32*b*" or central 32*b* surface are each called side convex radius R3, R5, R11, R13 or R7, R9 and extend between the concave surfaces and the other convex radius of the intermediate 32*b*" or central 32*b* convex surface, each called central convex radius R4, R8, R12. Each side convex radius R3, R5, R11, R13 or R7, R9 has a radius value sufficiently large to be continuous with the concave radiuses R2, R6, R10 and R14 of the concave surfaces 31*b*. In other words, the convex radiuses R3, R5, R11, R13 or R7, R9 are rounded tangentially with the concave radiuses. The central convex radiuses R4, R8, R12 have smaller radiuses each including the tops of the intermediate 32*b*" or central 32*b* convex surfaces. Thus, the side convex radiuses R3, R5, R11, R13 or R7, R9 are connected in a tangential manner with respectively the concave radiuses R2, R6, R10 and R14 as well as with the central convex radiuses R4, R8, R12.

In this example, the upstream convex surface 32*b*7 and the downstream convex surface 32*b*8 each include respectively a convex radius R1 and R15 connected in a tangential manner with respectively the concave radiuses R2 and R14.

Figure 4A:
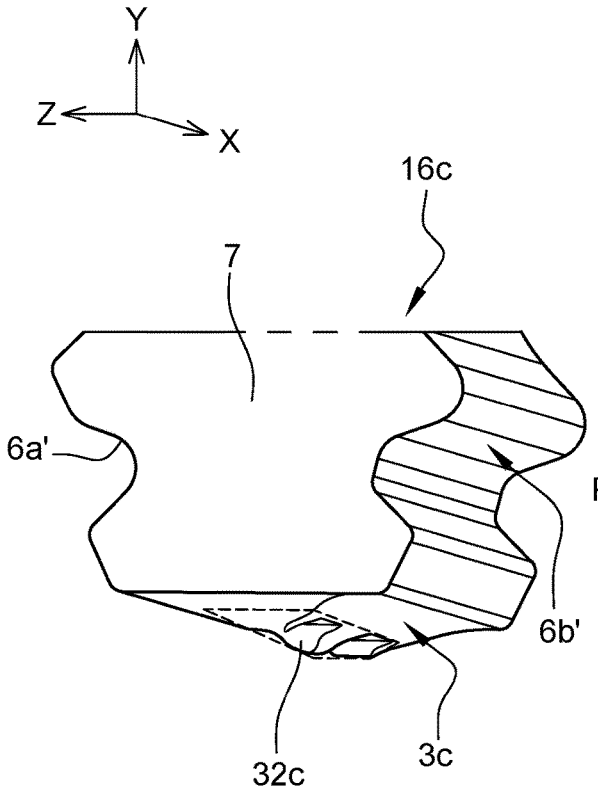
FIGS. 4*a* and 4*b* each represent a perspective of a third embodiment of blade root according to the invention.
Figure 4B:
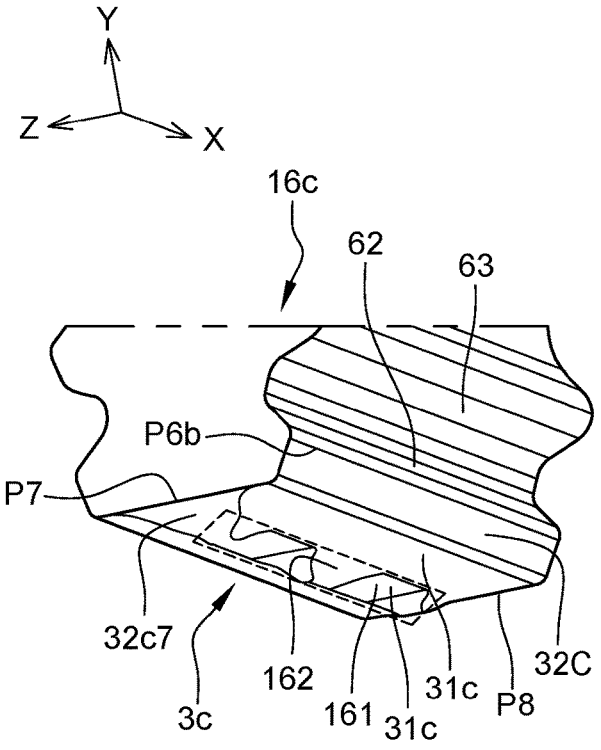

According to a third embodiment represented in FIGS. 4*a* and 4*b*, the blade is identical except in that the root 16*c* includes a radially inner face 3*c* different from the radially inner faces 3, 3*b* of the two other embodiments.

In this third embodiment, the radially inner face 3*c* comprises an undulated region represented in dashed lines including undulated convex surfaces 32*c* including convex radiuses along the longitudinal direction and convex radiuses in the transversal direction, that is to say the tangential direction Z.

In this example of this third embodiment, the root 16*c* comprises hollows 161 and bosses 162 in the undulated region of the radially inner face 3*c*. These hollows 161 and bosses 162 extend one after the other longitudinally. In this case there are three hollows 161 and two bosses 162.

Each hollow 161 and each boss 162 includes a curvature which extends both in the tangential direction Z and in the longitudinal direction Y.

The three bosses 162 are laid out in line with the three inter-cavity partitions 44 including an axial surface forming the bottom 41 of the recessed pocket 4' represented in FIG. 5 and the two hollows 161 are facing the two so-called central cooling channels 43 emerging radially in the bottom 41 of the recessed pocket.

In this example, the radially inner face 3*c* further includes, on either side of the undulated region, a concave surface 31*c'* having a concave radius along the transversal direction like the concave surface 31 of the first embodiment. The concave surface 31*c'* extends along the undulated region and thus includes a portion of cylinder having an axis extending longitudinally like the concave surface 31 of the first example. This concave surface 31*c'* extends from the upstream longitudinal end 7*c* and the downstream longitudinal end.

In this example, the radially inner face 3 further includes, besides two concave surfaces 31, two side convex surfaces 32*c'* along the side faces 6*a'* and 6*b'* like the side convex surface 32' in the example of the first embodiment.

According to another example, not represented, the undulated region is surrounded by a side convex surface. In other words, the undulated region extends up to the side convex surface.

In this example represented in FIGS. 4*a* and 4*b*, the radially inner face 3*c* further includes, between the undulated region and the upstream face, an upstream concave surface 32*c*7 extending from one length end p7 forming the intersection line between the upstream face 7 and the radially inner face 3*c*. In this example, the radially inner face 3*c* further includes, between the undulated region and the downstream face, a downstream concave surface extending from one length end P8 forming the intersection line between the downstream face and the radially inner face 3*c*.

The upstream concave surface 32*c*7 and the downstream concave surface are laid out in line with the two other upstream and downstream cooling channels 43 and two upstream and downstream inter-cavity partitions 44 including an axial surface forming the bottom 41 of the recessed pocket 4'. Thus, this makes it possible to limit the mass of the blade.

The present invention relates to in this case in these examples a rotor disc of a high pressure turbine. However, the rotor disc may also be a rotor disc of a low pressure turbine. Generally speaking, the present invention thus relates to any turbomachine rotor disc. The present invention is naturally not limited to a particular type of fastener for the mounting of the blade roots on the rotor discs. Notably the examples of the second and third embodiment may have side faces like the first example of the first embodiment to be inserted into a recessed pocket of the first example of the first embodiment. Generally speaking, the present invention applies to any blade comprising a root intended to be mounted in a recessed pocket of a rotor disc while conserving, thanks to the mounting clearance between the root of the blade and the bottom of the recessed pocket, a space for circulating cooling air.

The invention claimed is:

1. A turbomachine blade comprising a root adapted to be mounted in a recessed pocket of a turbomachine rotor disc while extending radially vis-à-vis a longitudinal axis, the root having:

a. two side faces extending radially and axially, each of the two side faces including at least one seating to be in contact against a wall of the recessed pocket, along the longitudinal axis, b. a radially inner face to face the bottom of the recessed pocket when the root is mounted in the recessed pocket, the radially inner face connecting the two side faces, the radially inner face comprising an undulation including at least one first rounded surface, a second rounded surface and a third rounded surface, the second rounded surface extending from one end of each of the first and third rounded surfaces, the first and third surface being separate from each other and wherein:

i. the first rounded surface and the third rounded surface are concave, and the second rounded surface is convex, ii. or the first rounded surface and the third rounded surface are convex and the second rounded surface is concave, and wherein the radially inner face includes a plurality of undulations formed by an alternation of concave and convex surfaces along the longitudinal axis to avoid having a sharp edge between the alternation of concave and convex surfaces.

2. The turbomachine blade according to claim 1, wherein the rounded concave and convex surfaces undulate along the longitudinal axis from an upstream face of the root to a downstream face of the root.

3. The turbomachine blade according to claim 2, wherein the concave and convex surfaces are aligned along the longitudinal axis.

4. The turbomachine blade according to claim 3, wherein each rounded concave or convex surface extends into a median region of the radially inner surface of the root, the median region being situated at a distance from the two side faces of the blade root.

5. The turbomachine blade according to claim 1, wherein the rounded concave and convex surfaces undulate in the transversal direction while connecting together the two side faces.

6. An assembly of at least one turbomachine blade according to claim 1 and a turbomachine rotor disc mounted around the longitudinal axis and including, on a periphery thereof, a plurality of recessed pockets regularly distributed around the longitudinal axis, the root of said at least one blade being mounted in a recessed pocket of the plurality of recessed pockets so as to form a mounting clearance between the root of the blade and the bottom of said recessed pocket.

7. The assembly according to claim 6 wherein the recessed pocket includes cooling channels which emerge radially in the bottom of said recessed pocket and inter-cavity partitions that separate the cooling channels and wherein the convex surfaces of the root of the blade are laid out in line with the inter-cavity partitions.

* * * * *